US011825884B2

(12) United States Patent
Carlino et al.

(10) Patent No.: US 11,825,884 B2
(45) Date of Patent: Nov. 28, 2023

(54) COLLAR CONSTRUCTION FOR AN UPPER-BODY GARMENT

(71) Applicant: NIKE, Inc., Beaverton, OR (US)

(72) Inventors: Shannan C. Carlino, Portland, OR (US); Iustinia Koshkaroff, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 43 days.

(21) Appl. No.: 16/816,586

(22) Filed: Mar. 12, 2020

(65) Prior Publication Data

US 2020/0297038 A1 Sep. 24, 2020

Related U.S. Application Data

(60) Provisional application No. 62/821,643, filed on Mar. 21, 2019.

(51) Int. Cl.
*A41B 3/00* (2006.01)

(52) U.S. Cl.
CPC ..... *A41B 3/00* (2013.01); *A41B 2500/10* (2013.01); *A41B 2500/20* (2013.01); *A41B 2500/30* (2013.01)

(58) Field of Classification Search
CPC ..... A41B 1/00; A41B 3/00; A41B 2500/10; A41B 2500/20; A41B 2500/30;
(Continued)

(56) References Cited

U.S. PATENT DOCUMENTS 286,781 A * 10/1883 Cleveland ..... A41B 3/00 2/116
456,999 A * 8/1891 Messer ..... A41B 1/16 2/127

(Continued)

FOREIGN PATENT DOCUMENTS

CN 2598368 Y 1/2004
CN 202566365 U 12/2012

(Continued)

OTHER PUBLICATIONS

International Search Report and Written Opinion received for PCT Patent Application No. PCT/US2020/023073, dated Jun. 9, 2020, 15 pages.

(Continued)

*Primary Examiner* — Bao-Thieu L Nguyen
*Assistant Examiner* — Uyen T Nguyen
(74) *Attorney, Agent, or Firm* — SHOOK, HARDY & BACON L.L.P.

(57) ABSTRACT

Aspects herein are directed to an upper-body garment having a collar construction formed from a back collar panel and at least one front collar panel, where each of the back collar panel at the front collar panel comprise terminal ends. The terminal ends of the front collar panel and the back collar panel are in an overlapping relationship at a first side and a second side of a neck opening of the upper-body garment. The terminal ends of the front collar panel are detached from the terminal ends of the back collar panel to provide enhanced stretch at the lateral sides of the neck opening when donning and doffing the upper-body garment.

19 Claims, 8 Drawing Sheets

(58) Field of Classification Search
CPC ..... A41B 1/12; A41B 1/16; A41B 13/005; A41D 2400/44; A41D 27/18; A41D 1/04; A41D 13/1272; A41D 13/129; A41D 3/005; A41D 13/0015; A41D 2500/10; A41D 2500/20; A41D 2600/10
USPC ..... 2/116, 106, 115, 129; D2/717, 840–842, D2/602, 604; D29/100–101.5; 66/169 R
See application file for complete search history.

(56) References Cited

U.S. PATENT DOCUMENTS

| | | | | | |
|---|---|---|---|---|---|
| 1,046,128 | A * | 12/1912 | Weisbaum | A41B 1/16 | 2/127 |
| 1,696,671 | A * | 12/1928 | Duncan | A41D 1/04 | 2/116 |
| 2,525,692 | A | 10/1950 | Lerner | | |
| 2,677,826 | A * | 5/1954 | Piacenza | A41D 27/18 | 2/128 |
| 2,707,786 | A * | 5/1955 | Stoner | A41D 27/18 | 2/119 |
| 4,793,034 | A | 12/1988 | Poloff et al. | | |
| 5,584,197 | A * | 12/1996 | Okuno | D04B 1/24 | 66/172 R |
| 5,896,578 | A * | 4/1999 | Hunter | A41D 13/012 | 2/2.15 |
| 6,053,852 | A * | 4/2000 | Wilkinson | A41D 13/0015 | 482/121 |
| 6,192,716 | B1 | 2/2001 | Essig et al. | | |
| 6,378,136 | B2 | 4/2002 | Matsushita | | |
| 6,786,066 | B2 | 9/2004 | Okamoto | | |
| 7,168,271 | B2 | 1/2007 | Yui | | |
| D625,899 | S | 10/2010 | Reis | | |
| D632,460 | S | 2/2011 | Kinder | | |
| D732,278 | S | 6/2015 | Dwamena | | |
| 9,226,536 | B2 | 1/2016 | Nordstrom | | |
| 9,320,308 | B2 | 4/2016 | Forbes et al. | | |
| D793,651 | S * | 8/2017 | Jascomb | D2/602 | |
| 10,004,280 | B2 | 6/2018 | Farron et al. | | |
| 2001/0034891 | A1* | 11/2001 | Matsushita | A41D 13/1245 | 2/129 |
| 2002/0005153 | A1* | 1/2002 | Ribble | A41D 27/10 | 112/475.08 |
| 2004/0154342 | A1* | 8/2004 | Okamoto | A41D 27/18 | 66/169 R |
| 2006/0143779 | A1* | 7/2006 | Lee | A41D 27/08 | 2/115 |
| 2010/0186138 | A1 | 7/2010 | Hale | | |
| 2013/0125284 | A1 | 5/2013 | Shiue | | |
| 2014/0047614 | A1* | 2/2014 | Becton | A41D 1/00 | 2/84 |
| 2015/0196067 | A1* | 7/2015 | Blakely | A41D 31/185 | 2/69 |
| 2018/0007985 | A1* | 1/2018 | Fukuda | A41D 13/0015 | |
| 2018/0325195 | A1* | 11/2018 | Emoff | A41B 9/06 | |
| 2019/0297967 | A1* | 10/2019 | Buffalini | A41D 13/1245 | |

FOREIGN PATENT DOCUMENTS

| | | | |
|---|---|---|---|
| CN | 104273716 | A | 1/2015 |
| EP | 1394308 | A1 | 3/2004 |
| FR | 1052282 | A | 1/1954 |
| GB | 999172 | | 7/1965 |
| JP | 5022790 | B2 | 9/2012 |
| JP | 6027697 | B1 | 10/2016 |
| WO | 2017/192654 | A4 | 12/2017 |

OTHER PUBLICATIONS

International Preliminary Report on Patentability received for PCT Patent Application No. PCT/US2020/023073, dated Sep. 30, 2021, 10 pages.

"100% Merino Wool Aran Crafts Ladies Knit Poncho Charcoal", Aran Crafts, Amazon.com, ASIN: B00YSLUTIU, Available online at: <https://www.amazon.com/Aran-Crafts-Cable-Poncho-Charcoal/dp/B00YSMLA0U/ref=pd_rhf_dp_p_img_1?_encoding=UTF8&psc=1&refRID=FX0ASJMSVJXD7NK9HDFX>, Accessed on May 11, 2020, 3 pages.

"Aran Crafts Men's Irish Cable Knitted Shawl Collar Sweater (100% Merino Wool)", Aran Crafts, Amazon.com, ASIN: B0777LPRS7, Available online at: <https://www.amazon.com/Aran-Crafts-Irish-Merino-Shawl/dp/B00K0KL6DU?th=1>, Accessed on May 11, 2020, 7 pages.

"Free Shipping High Quality Mens Sleeveless Cardigan Sweaters Wholesale Zipper Collar Design Men's Fashion Casual Solid Color Sweater MQ31Y", DHgate.com, Item Code: 212144163, Available online at: <https://www.dhgate.com/product/high-quality-mens-sleeveless-cardigan-sweaters/212144163.html>, Jan. 22, 2019, pp. 1-9.

* cited by examiner

COLLAR CONSTRUCTION FOR AN UPPER-BODY GARMENT

CROSS-REFERENCE TO RELATED APPLICATIONS

This application filed Mar. 12, 2020 and having U.S. application Ser. No. 16/816,586, entitled "Collar Construction for an Upper-Body Garment," claims the benefit of priority of U.S. Prov App. No. 62/821,643, entitled "Collar Construction for an Upper-Body Garment," and filed Mar. 21, 2019. The entirety of the aforementioned application is incorporated by reference herein.

TECHNICAL FIELD

Aspects herein are directed to a collar construction for an upper-body garment that facilitates easy donning and doffing.

BACKGROUND

Traditional crew-neck collar constructions comprise a single, annular piece of material that is affixed to a neck opening of an upper-body garment. Such constructions may cause difficulty when donning and doffing the upper-body garment by having limited stretch.

BRIEF DESCRIPTION OF THE DRAWINGS

Examples of aspects herein are described in detail below with reference to the attached drawing figures, wherein.

DETAILED DESCRIPTION

Figure 1:
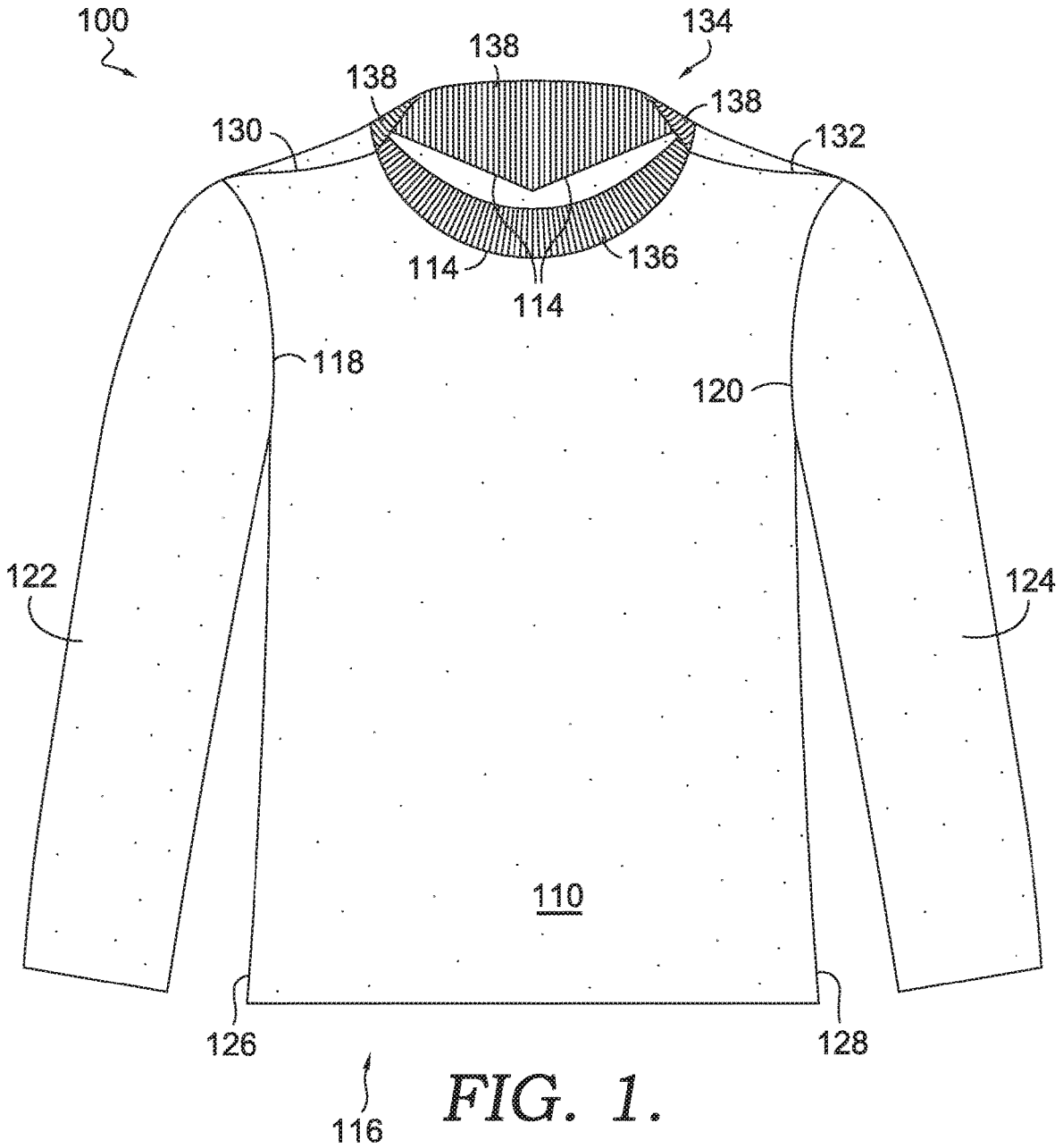
FIG. 1 illustrates a front view of a first example upper-body garment having a first collar configuration in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to example collar constructions that facilitate easy donning and doffing of, for instance, an upper-body garment incorporating the collar construction. Instead of, for example, a traditional crew-neck collar construction that comprises a single, annular piece of material that is affixed to a neck opening of an upper-body garment, the current aspect utilizes two or more collar panels, such as a front collar panel and a back collar panel, that are joined to a neck opening of an upper-body garment such that the terminal ends of the respective collar panels overlap at the opposing sides of the neck opening. Additionally, in the areas where the terminal ends of the front and back collar panels overlap, the terminal ends are not joined or affixed to each other so that they can move independently of each other in response to, for instance, tensioning forces allowing for a greater degree of stretch as compared to traditional annular constructions. For instance, a traditional male annular crew-neck construction may measure about 22 cm from a first side to a second side of the neck opening in a resting state and may expand to, for instance, about 30 to 31 cm when stretched. Aspects herein contemplate that the collar construction described herein may measure about 22 cm from a first side to a second side of the neck opening in a resting state and may expand to, for instance, about 40 cm when stretched. Thus, when a wearer dons or doffs an upper-body garment having the example collar construction, the wearer may more easily pull the collar over her head. This may be especially helpful for wearers with physical disabilities who may struggle with donning and doffing upper-body garments.

In one example collar construction, which may conform to a crew-neck type collar, a front collar panel and a back collar panel are used to form the collar construction. The front collar panel has a superior edge, an inferior edge, a first terminal end, and a second terminal end opposite the first terminal end. The inferior edge of the front collar panel is affixed to a front side of a neck opening of an upper-body garment. The back collar panel also has a superior edge, an inferior edge, a first terminal end, and a second terminal end opposite the first terminal end. The inferior edge of the back collar panel is affixed to a back side of the neck opening. The first terminal end of the front collar panel is in an overlapping relationship with the first terminal end of the back collar panel at a first lateral side of the neck opening, and the second terminal end of the front collar panel is in an overlapping relationship with the second terminal end of the back collar panel at a second lateral side of the neck opening. The terminal ends of the respective front and back collar panels are detached from each other in the areas in which they overlap.

In a second example collar construction, which may conform to a V-neck type collar, a first front collar panel, a second front collar panel, and a back collar panel are used to form the collar construction. Each of the first front collar panel and the second front collar panel have a superior edge, an inferior edge, a first terminal end, and a second terminal end opposite the first terminal end. The inferior edge of the first front collar panel is affixed to a first front side of a neck opening of an upper-body garment, and the inferior edge of the second front collar panel is affixed to a second front side of the neck opening. The inferior edge of the back collar panel is affixed to a back side of the neck opening. The first terminal end of the first front collar panel is in an overlapping relationship with the first terminal end of the back collar panel at a first lateral side of the neck opening, and the first terminal end of the second front collar panel is in an overlapping relationship with the second terminal end of the back collar panel at a second lateral side of the neck opening. The terminal ends of the respective collar panels are detached from each other in the areas in which they overlap. As described above, constructing the collars as described provides a greater degree of stretch at least at the lateral sides of the collar construction which facilitates easy donning and doffing. Moreover, the use of the collar constructions as described provides for a different and desired aesthetic than, for instance, garments having a boat-neck type construction that do not utilize collar panels.

In example aspects, the collar panels described above may be formed from a material having two-way stretch or four-way stretch. For instance, the collar panels may be formed of a knit material having a ribbed knit structure where the longitudinal axes of the ribs are oriented generally perpendicular to the inferior edges of the respective collar panels. This orientation, as opposed to having the ribs oriented generally horizontal or parallel to the inferior edges of the collar panels, allows for an enhanced degree of stretching in the lateral or width-wise direction when the collar panels are incorporated into the upper-body garment. In example aspects, the material used to form the collar panels may have a greater stretch characteristic (i.e., more stretch) than, for instance, a material used to form the upper-body garment. As an example, the material used to form the upper-body garment may comprise a knit material without ribbed knit structures, a woven material, a non-woven material, and the like. This may be advantageous in aspects where enhanced stretch is not necessarily needed in the upper-body garment (e.g., cold-weather, woven outer-wear garments), but the upper-body garment must still be donned and doffed by pulling the neck opening of the upper-body garment over the wearer's head.

To further facilitate donning and doffing the upper-body garment, the back collar panel may be shaped or formed so that a center portion of the inferior edge extends inferiorly a greater distance than a first side portion and a second side portion of the inferior edge resulting in a "V-shape" of the back collar panel along its inferior edge. This provides a greater amount of high stretch material at the back of the collar which further assists, for example, the donning of the upper-body garment especially as the collar is pulled over the top and posterior part of the wearer's head.

As used herein, positional terms such as "medial," "lateral," "front," "back," "superior," "inferior," "anterior," "posterior," "side," and the like are with respect to an upper-body garment having the collar constructions described herein being worn as intended and as shown and described herein by a wearer standing in anatomical position. For example, the term "front" when describing a garment having the collar construction described herein may mean that the front of the garment and/or collar is configured to cover a front torso area and/or a front neck area respectively of a wearer. Similarly, the term "back" may mean that the back of the garment and/or collar is configured to cover a back torso area and/or a back neck area respectively of a wearer. The term "side" may mean that the garment and/or collar is configured to cover a side torso area and/or side neck area respectively. With respect to the terms "medial" and "lateral," the term "medial" means positioned near the median plane of the upper-body garment and/or a wearer wearing the upper-body garment, and the term "lateral" means positioned toward the sides of the garment and/or a wearer wearing the garment. Thus, a structure that is positioned medial to another structure would be positioned closer to the median plane of the upper-body garment and/or a wearer wearing the upper-body garment. A structure that is positioned lateral to another structure would be positioned closer to the sides of the upper-body garment and/or a wearer wearing the upper-body garment. The term "inner-facing surface means a surface that is positioned closer to a body surface of a wearer when the upper-body garment is worn, and the term "outer-facing surface" means a surface that is positioned opposite the inner-facing surface and is positioned to face in a direction toward an external environment of the upper-body garment.

The term "terminal end" as used herein with respect to the collar panels means the opposing ends of the collar panel pieces when they are incorporated into an upper-body garment. In one example aspect, the terminal ends may be formed by the intersection of the superior edge and the inferior edge of the respective panels. The term "terminal end" is not necessarily meant to convey the outermost edge of the end of the collar panel, but, instead, the area adjacent to the outermost edge of the end of the collar panel (i.e., within about ±1 cm to about 5 cm medial to the outermost edge of the end of the collar panel). As used herein, the term "about" means within ±5% of a designated value.

With respect to the term "overlapping relationship" when referring to the terminal ends of the front and back collar panels, this means that a textile surface of, for instance, a first terminal end of a front collar panel is positioned adjacent to a textile surface of the first terminal end of the back collar panel. The term "overlapping relationship" may mean that the two textile surfaces are in physical contact with each other (i.e., are touching each other but are not attached to each other) but may also mean that the two textile surfaces are in close proximity to each other but not necessarily in physical contact.

Unless otherwise noted, all measurements provided herein are measured at standard ambient temperature and pressure (25 degrees Celsius or 298.15 K and 1 bar) when the upper-body garment and/or the collar is in a resting, non-tensioned state.

Figure 2:
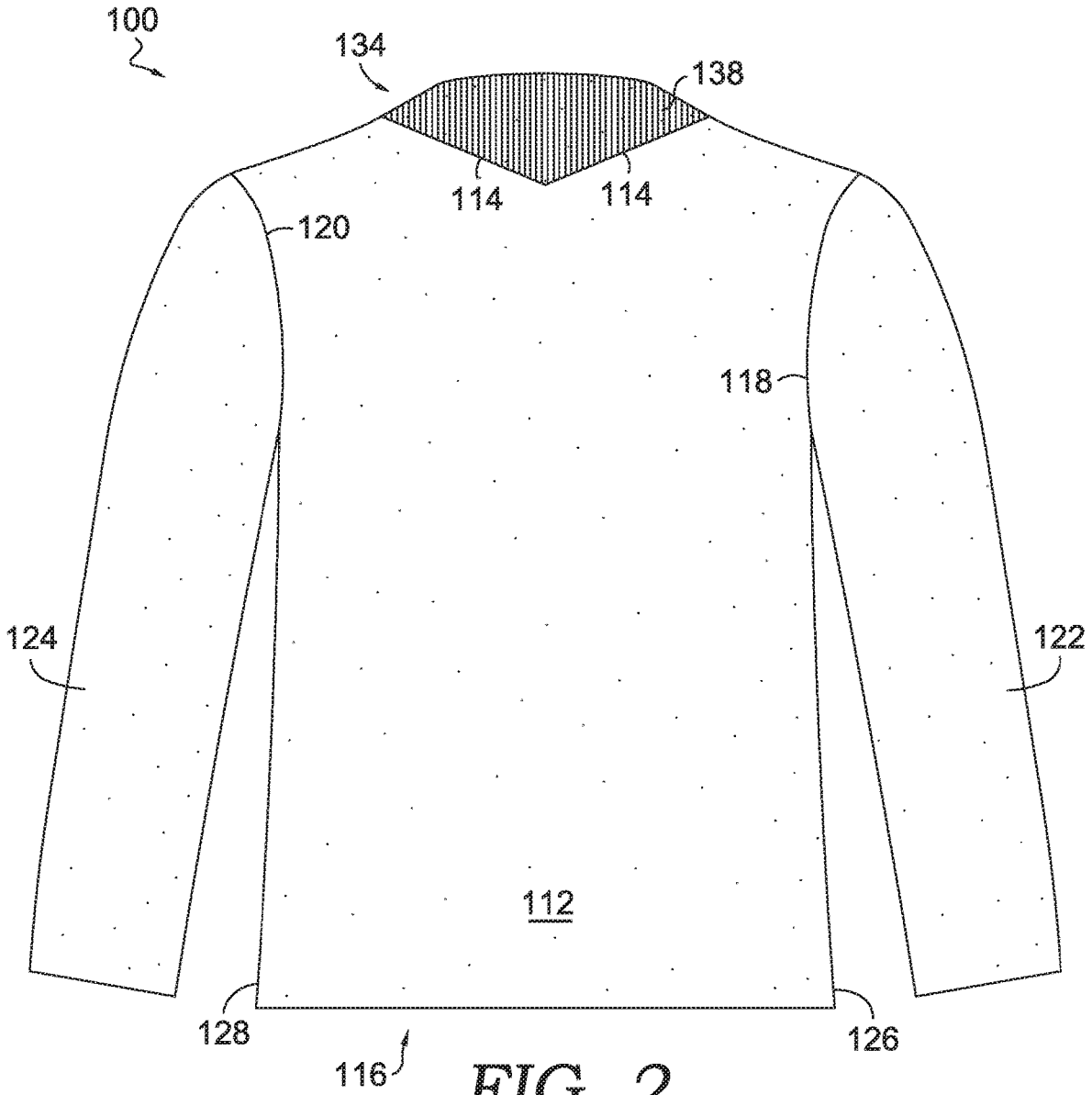
FIG. 2 illustrates a back view of the first example upper-body garment of FIG. 1 in accordance with aspects herein.

Turning now to FIGS. 1 and 2, front and back views respectively of an example upper-body garment 100 are provided in accordance with aspects herein. The upper-body garment 100 comprises a front portion 110 (shown in FIG. 1) and a back portion 112 (shown in FIG. 2) that together define a neck opening 114 and a waist opening 116. In example aspects, the neck opening 114 can be divided into general regions or sides. For example, the neck opening 114 may comprise a front side, a back side, a first side, and a second side where the front side is generally located on an anterior aspect of the upper-body garment 100, the back side is generally located on a posterior aspect of the upper-body garment 100, the first side is generally located at the lateral extent of a right side of the neck opening 114, and the second side is generally located at the lateral extent of a left side of the neck opening 114. The denoting of different sides or regions of the neck opening 114 are not meant to indicate rigid demarcation lines. For instance, when describing the front collar panel as being affixed to a front side of the neck opening 114, it is contemplated herein that the terminal ends of the front collar panel may extend slightly on to the back portion 112 of the upper-body garment 100. Similarly, when describing the back collar panel as being affixed to a back side of the neck opening 114, it is contemplated herein that the terminal ends of the back collar panel may extend slightly on to the front portion 110 of the upper-body garment 100. When describing the terminal ends of the front and back collar panels, it is contemplated herein that the terminal ends may extend slightly on to the front portion 110 and/or the back portion 112 of the upper-body garment 100.

The front portion 110 and the back portion 112 may further define a first sleeve opening 118 and a second sleeve opening 120 from which an optional first sleeve 122 and second sleeve 124 respectively may extend. Although shown as a long-sleeve upper-body garment, it is contemplated herein that the upper-body garment 100 may comprise a sleeveless construction, may comprise half-sleeves, three-quarter sleeves, quarter sleeves, cap sleeves, and the like.

In example aspects, the front portion 110 and the back portion 112 may comprise two separate panels of material that are joined together (i.e., seamed together) at a first side seam 126 and a second side seam 128 where the first and second side seams 126 and 128 are positioned on opposing lateral sides of the upper-body garment 100. To describe it differently, the first and second side seams 126 and 128 may extend from an inferior margin of the first and second sleeve openings 118 and 120 respectively to the waist opening 116. The front portion 110 and the back portion 112 may also be joined together (i.e., seamed together) at a first shoulder seam 130 and a second shoulder seam 132 where the first and second shoulder seams 130 and 132 are positioned on opposing sides of the neck opening 114. To describe it differently, the first and second shoulder seams 130 and 132 may extend from opposing lateral margins of the neck opening 114 to a superior margin of the first and second sleeve openings 118 and 120 respectively. It is also contemplated herein that the front portion 110 and the back portion 112 may comprise a single pattern piece or multiple pattern pieces that are joined together to form the upper-body garment 100 such that the upper-body garment 100 may be seamless (e.g., when a single pattern piece is used) or may comprise additional seams positioned at various locations on the upper-body garment 100.

In example aspects, the front portion 110 and the back portion 112 may be formed from a material having a stretch characteristic where the stretch characteristic may include no-stretch or low stretch. For instance, the front portion 110 and the back portion 112 may be formed of a knit material, a woven material, a non-woven material, a braided material, and the like. In example aspects, the knit material, the woven material, the non-woven material, and the braided material may not include elastomeric yarns such as, for example, spandex or elastane.

The upper-body garment 100 comprises a collar construction that is referenced generally by the numeral 134. In example aspects, the collar construction 134 has the appearance of a crew-neck type collar construction. The collar construction 134 comprises a front collar panel 136 and a separate back collar panel 138. As shown more clearly in the back view of FIG. 2, the back collar panel 138 includes a center portion that extends inferiorly a greater extent than side portions of the back collar panel 138 to form a "V-shape." As will be explained in greater detail below, by forming the back collar panel 138 as described, a greater amount of high stretch material is positioned at the back neckline which may facilitate the pulling of the collar construction 134 over the top and posterior side of a wearer's head when donning the upper-body garment 100.

Figure 3A:
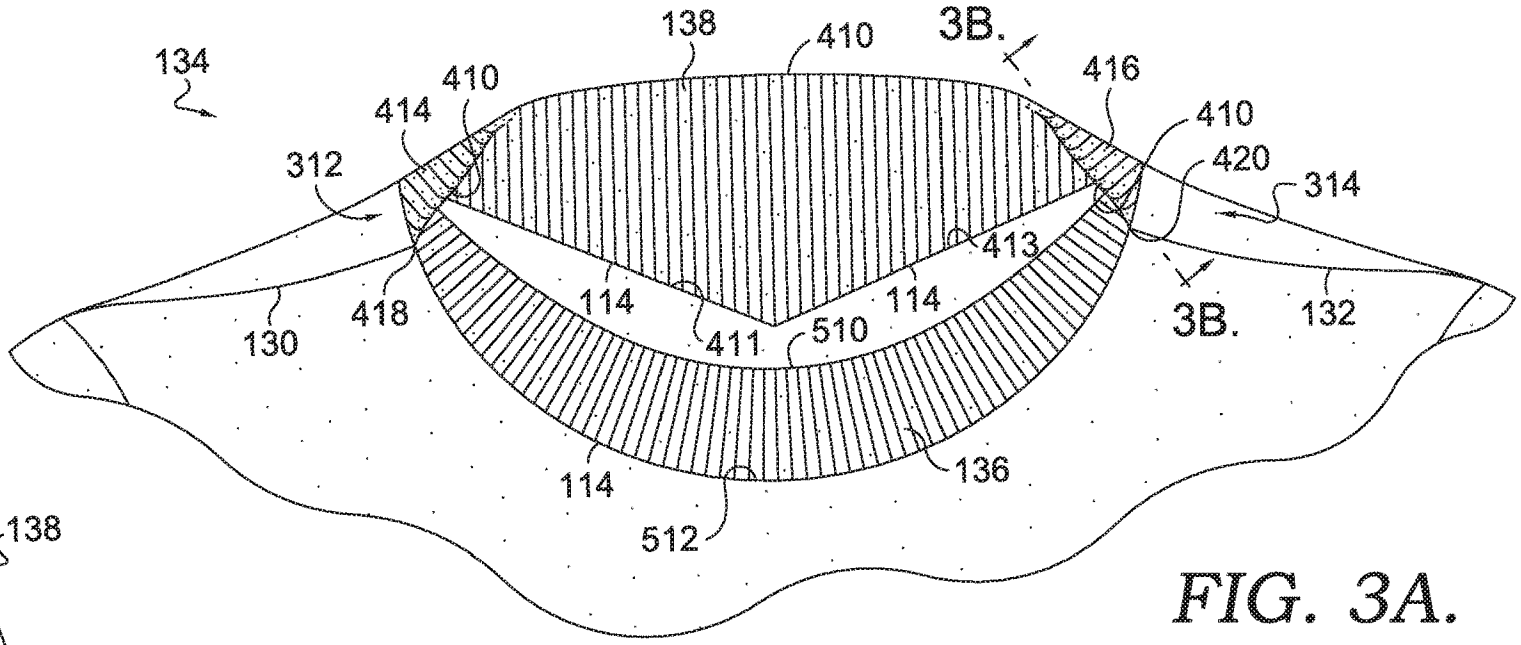
FIG. 3A illustrates a front, close-up view of the first collar configuration of the first example upper-body garment of FIG. 1 in accordance with aspects herein.
Figure 4:
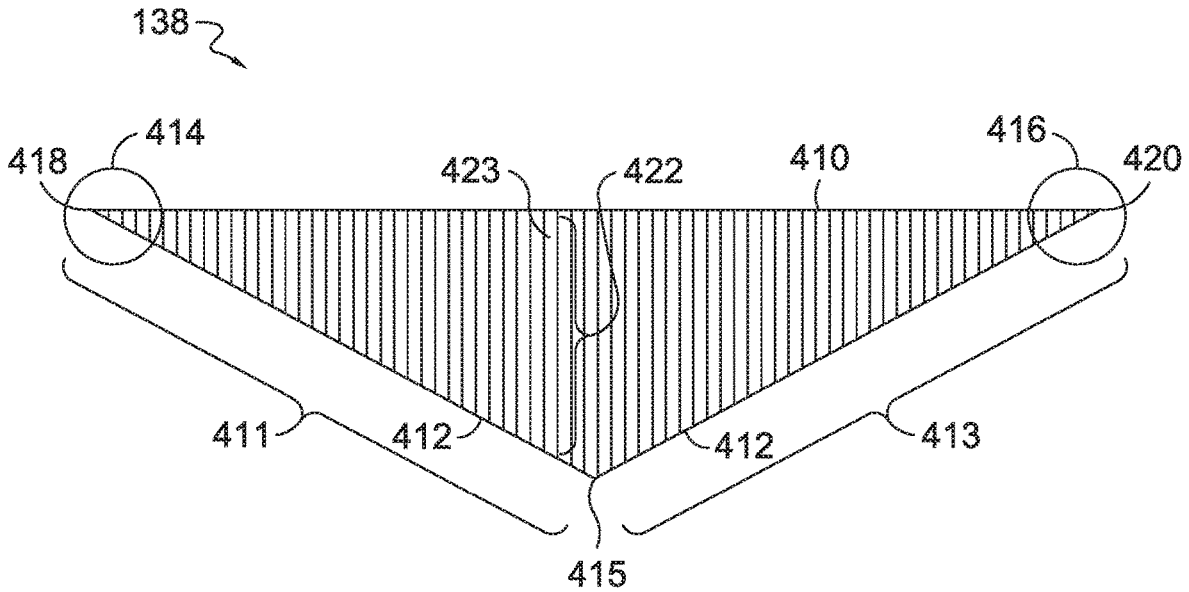
FIG. 4 illustrates a view of a back collar panel of the first collar configuration in accordance with aspects herein.
Figure 5:
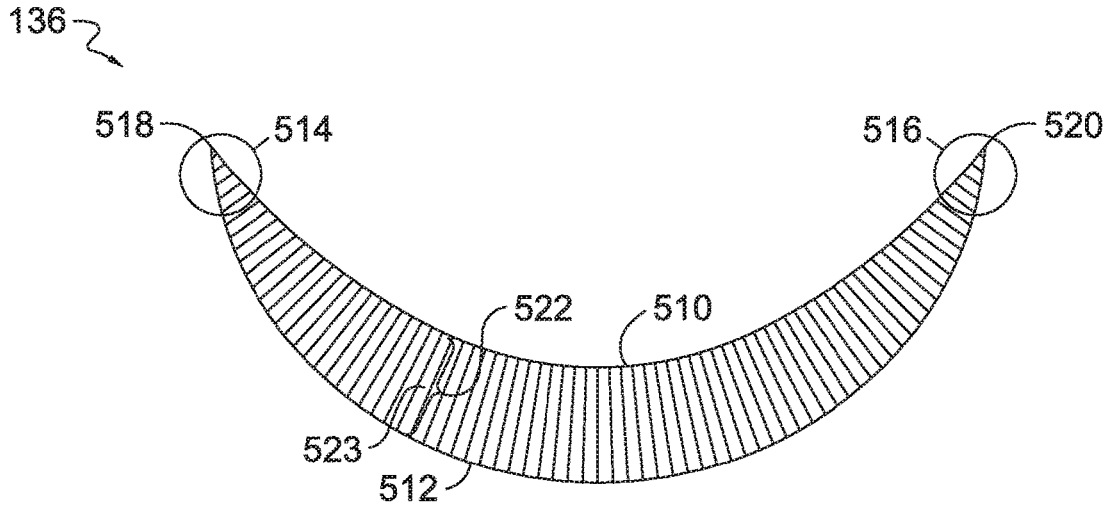
FIG. 5 illustrates a view of a front collar panel of the first collar configuration in accordance with aspects herein.

FIG. 3A illustrates a front, close-up view of the collar construction 134, while FIG. 4 depicts a pattern piece used to form the back collar panel 138, and FIG. 5 depicts a pattern piece used to form the front collar panel 136 in accordance with aspects herein. Referring collectively to FIGS. 3A and 4, the back collar panel 138 comprises a superior edge 410, an inferior edge 412, a first terminal end 414, and a second terminal end 416 opposite the first terminal end 414. Before being incorporated into the collar construction 134, the superior edge 410 of the back collar panel 138 may linearly extend (i.e., extend in a horizontal direction) between the first terminal end 414 and the second terminal end 416 as shown in FIG. 4. As further shown in FIG. 4, the inferior edge 412 may comprise a first segment 411 that extends inferiorly from the first terminal end 414 to a vertex 415 and a second segment 413 that extends inferiorly from the second terminal end 416 to the vertex 415 resulting in a V-shaped inferior edge.

With continued respect to FIG. 4, in example aspects, the first terminal end 414 and the second terminal end 416 of the back collar panel 138 may comprise respective areas adjacent to where the superior edge 410 of the back collar panel 138 intersects the inferior edge 412 of the back collar panel 138. More particularly, the first terminal end 414 of the back collar panel 138 may comprise an area adjacent to where the superior edge 410 of the back collar panel 138 intersects the first segment 411 of the inferior edge 412 where the intersection point is indicated by reference numeral 418, and the second terminal end 416 of the back collar panel 138 may comprise an area adjacent to where the superior edge 410 of the back collar panel 138 intersects the second segment 413 of the inferior edge 412 where the intersection point is indicated by reference numeral 420. The first terminal end 414 of the back collar panel 138 may comprise an area extending medially from about 1 cm to about 5 cm from the intersection point 418. Likewise, the second terminal end 416 of the back collar panel 138 may comprise an area extending medially from about 1 cm to about 5 cm from the intersection point 420.

When the back collar panel 138 is incorporated into the upper-body garment 100, the inferior edge 412 of the back collar panel 138 is affixed to a back side of the neck opening 114 using, for instance, stitching, adhesives, bonding, seam tape, spot welding, and the like. In example aspects, after the inferior edge 412 of the back collar panel 138 is affixed to the back side of the neck opening 114, the intersection point 418 is positioned adjacent to the first shoulder seam 130 so that the first shoulder seam 130 is in contact or near contact (e.g., within ±1 cm) of the intersection point 418, and the intersection point 420 is positioned adjacent to the second shoulder seam 132 so that the second shoulder seam 132 is in contact or near contact with the intersection point 420.

Referring now collectively to FIGS. 3A and 5, the front collar panel 136 comprises a superior edge 510, an inferior edge 512, a first terminal end 514, and a second terminal end 516 opposite the first terminal end 514. Before being incorporated into the collar construction 134, the superior edge 510 of the front collar panel 136 may comprise an arcuate shape or curved shape extending between the first terminal end 514 and the second terminal end 516. In example aspects, the inferior edge 512 may also comprise an arcuate shape or curved shape extending between the first terminal end 514 and the second terminal end 516. In some aspects, the radius of curvature of the superior edge 510 of the front collar panel 136 may be smaller than the radius of curvature of the inferior edge 512 of the front collar panel 136 as shown in FIGS. 3A and 5. Stated in a different way, a length of the superior edge 510 of the front collar panel 136 may be less than a length of the inferior edge 512 of the front collar panel 136.

With further respect to FIG. 5, in example aspects, the first terminal end 514 and the second terminal end 516 of the front collar panel 136 may comprise respective areas adjacent to where the superior edge 510 of the front collar panel 136 intersects the inferior edge 512 of the front collar panel 136 at opposing lateral sides of the front collar panel 136. More particularly, the first terminal end 514 of the front collar panel 136 may comprise an area adjacent to where the superior edge 510 of the front collar panel 136 intersects a first lateral side of the inferior edge 512 where the intersection point is indicated by reference numeral 518, and the second terminal end 516 of the front collar panel 136 may comprise an area adjacent to where the superior edge 510 of the front collar panel 136 intersects a second lateral side of the inferior edge 512 where the intersection point is indicated by reference numeral 520. The first terminal end 514 of the front collar panel 136 may comprise an area extending medially from about 1 cm to about 5 cm from the intersection point 518. Likewise, the second terminal end 516 of the front collar panel 136 may comprise an area extending medially from about 1 cm to about 5 cm from the intersection point 520.

When the front collar panel 136 is incorporated into the upper-body garment 100, the inferior edge 512 of the front collar panel 136 is affixed to a front side of the neck opening 114 using, for instance, stitching, adhesives, bonding, seam tape, spot welding, and the like. Because of the overlapping relationship between the first and second terminal ends 414 and 416 of the back collar panel 138 and the first and second terminal ends 514 and 516 of the front collar panel 136, the intersection points 518 and 520 of the front collar panel 136 are not visible in FIG. 3A but, in example aspects, they would each be located posterior to the first shoulder seam 130 and the second shoulder seam 132 respectively.

With respect to both the front collar panel 136 and the back collar panel 138, and as shown in FIGS. 4 and 5, the front collar panel 136 and the back collar panel 138 may be formed of a two-way or four-way stretch material such as, for example, a ribbed knit material that has a stretch characteristic. In example aspects, the front collar panel 136 and the back collar panel 138 may include elastomeric yarns such as spandex to impart the stretch characteristic. In example aspects, the stretch characteristic of the front collar panel 136 and the back collar panel 138 may be greater than the stretch characteristic of the material used to form the upper-body garment 100. In example aspects, the front and back collar panels 136 and 138 may be seamed to the neck opening 114 of the upper-body garment 100 so that the long axes of the ribs of the ribbed knit material forming the front and back collar panels 136 and 138 are oriented generally perpendicular to the superior edges 510 and 410 of the front and back collar panels 136 and 138 respectively. For instance, with respect to FIG. 4, a long axis 422 of rib 423 is oriented generally perpendicular (i.e., within ±20 degree of perpendicular) to the superior edge 410 of the back collar panel 138. And with respect to FIG. 5, a long axis 522 of rib 523 is oriented generally perpendicular to the superior edge 510 of the front collar panel 136. This construction may facilitate a greater degree of stretch in the lateral direction (i.e., the width direction) when donning and doffing the upper-body garment 100 as is a known feature of ribbed knit materials.

Figure 3B:
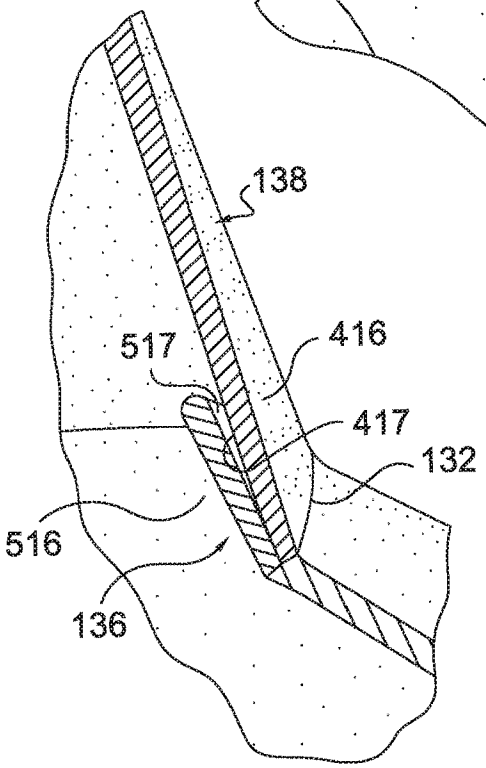
FIG. 3B illustrates a cross-sectional view taken along cut line 3B-3B of FIG. 3A in accordance with aspects herein.

Referring now to FIG. 3B, which illustrates a cross-sectional view taken along cut line 3B-3B of FIG. 3A, in example aspects, the second terminal end 516 of the front collar panel 136 is positioned medial to (i.e., closer to a median plane of the upper-body garment 100) the second terminal end 416 of the back collar panel 138 so that the second terminal end 516 of the front collar panel 136 and the second terminal end 416 of the back collar panel 138 are in an overlapping relationship at a second side 314 of the neck opening 114. A similar relationship holds true for the first terminal end 514 of the front collar panel 136 and the first terminal end 414 of the back collar panel 138 at a first side 312 of the neck opening 114. To state this differently, the intersection point 520 of the front collar panel 136 is positioned posterior to the intersection point 420 of the back collar panel 138 at the second side 314 of the neck opening 114. And, similarly, the intersection point 518 of the front collar panel 136 is positioned posterior to the intersection point 418 of the back collar panel 138 at the first side 312 of the neck opening 114 to cause the first and second terminal ends 514 and 516 of the front collar panel 136 to be in overlapping relationships with the first and second terminal ends 414 and 416 of the back collar panel 138 at the first and second sides 312 and 314 of the neck opening 114.

FIG. 3B further illustrates that although the first and second terminal ends 514 and 516 of the front collar panel 136 are in an overlapping relationship with the first and second terminal ends 414 and 416 of the back collar panel 138, the respective first and second terminal ends 514 and 414, and 516 and 416 are detached from each other in areas except for where the first and second terminal ends 514 and 414, and 516 and 416 are seamed or attached to the neck opening 114 of the upper-body garment 100. To describe this differently, an inner-facing surface 417 of the first and second terminal ends 414 and 416 of the back collar panel 138 are detached from or not affixed to an outer-facing surface 517 of the first and second terminal ends 514 and 516 of the front collar panel 136. As stated previously, by not affixing the first and second terminal ends 414 and 416 of the back collar panel 138 to the first and second terminal ends 514 and 516 of the front collar panel 136, the front and back collar panels 136 and 138 can move independently of each other at the first side 312 and the second side 314 of the neck opening 114 to allow for greater stretch when donning and doffing the upper-body garment 100.

It is also contemplated herein that the first terminal end 514 of the front collar panel 136 may be positioned lateral to (i.e., further away from the median plane of the upper-body garment 100) the first terminal end 414 of the back collar panel 138 at the first side 312 of the neck opening 114, and the second terminal end 516 of the front collar panel 136 may be positioned lateral to the second terminal end 416 of the back collar panel 138 at the second side 314 of the neck opening 114. Similar to above, the intersection point 518 would still be positioned posterior to the intersection point 418, and the intersection point 420 would still be positioned posterior to the intersection point 420, and the first and second terminal ends 514 and 516 of the front collar panel 136 would still be in an overlapping and detached relationship with the first and second terminal ends 414 and 416 of the back collar panel 138. Any and all aspects, and any variation thereof, are contemplated as being within the scope herein.

Figure 6:
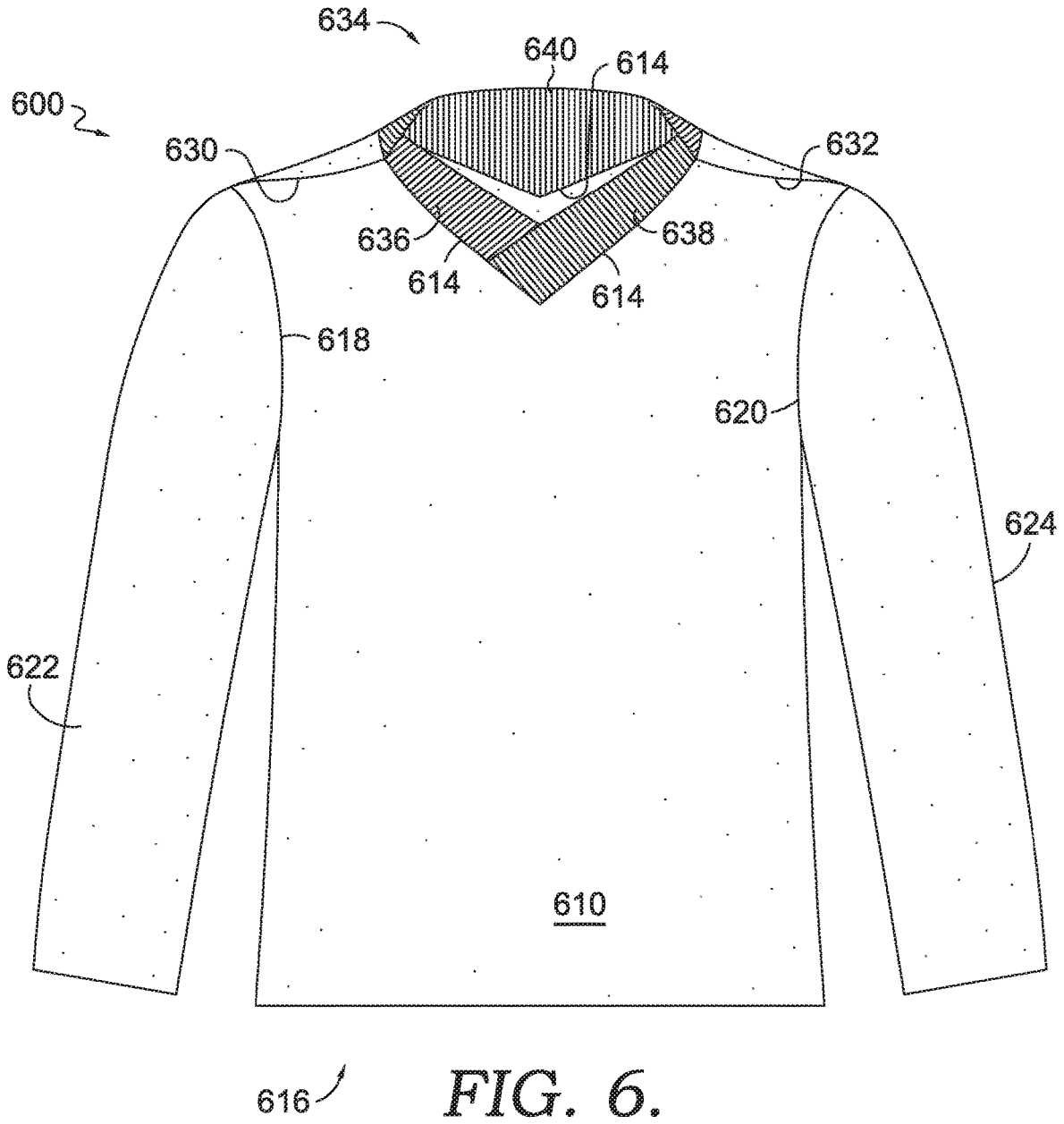
FIG. 6 illustrates a front view of a second example upper-body garment having a second collar configuration in accordance with aspects herein.

Turning now to FIG. 6, a front view of a second example upper-body garment 600 is illustrated in accordance with aspects herein. The upper-body garment 600 shares similar features as the upper-body garment 100 but includes a different collar construction. Many of the features related to the upper-body garment 100 may also apply to the upper-body garment 600 and will not be repeated here for the sake of brevity. For example, the upper-body garment 600 comprises a front portion 610 and a back portion which would look similar to the back portion 112 shown in FIG. 2. The front portion 610 and the back portion together define a neck opening 614 and a waist opening 616. Similar to the neck opening 114, the neck opening 614 can be divided into general regions or sides but the denoting of different sides or regions of the neck opening 614 are not meant to indicate rigid demarcation lines.

The front portion 610 and the back portion may further define a first sleeve opening 618 and a second sleeve opening 620 from which an optional first sleeve 622 and second sleeve 624 respectively may extend. Although shown as a long-sleeve upper-body garment, it is contemplated herein that the upper-body garment 600 may comprise a sleeveless construction, may comprise half-sleeves, three-quarter sleeves, quarter sleeves, cap sleeves, and the like.

In example aspects, the front portion 610 and the back portion may be joined together (i.e., seamed together) at side seams and at a first shoulder seam 630 and a second shoulder seam 632 where the first and second shoulder seams 630 and 632 are positioned on opposing sides of the neck opening 614.

In example aspects, similar to the upper-body garment 100, the front portion 610 and the back portion of the upper-body garment 600 may be formed from a material having a stretch characteristic where the stretch characteristic may include no-stretch or low stretch. For instance, the front portion 610 and the back portion may be formed of a knit material, a woven material, a non-woven material, a braided material, and the like.

The upper-body garment 600 comprises a collar construction that is referenced generally by the numeral 634. In example aspects, the collar construction 634 has the appearance of a V-neck type collar construction. The collar construction 634 comprises a first front collar panel 636, a second front collar panel 638, and a back collar panel 640.

Figure 7A:
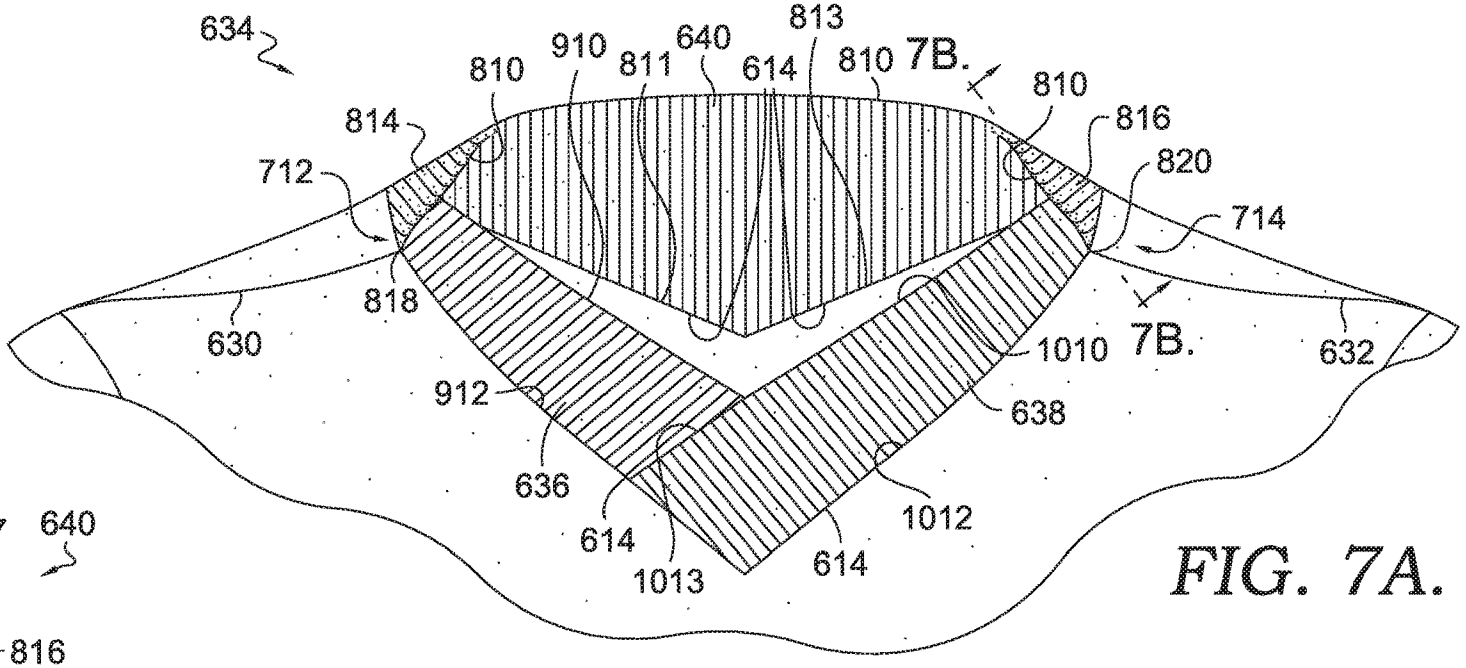
FIG. 7A illustrates a front, close-up view of the second collar configuration of the second example upper-body garment of FIG. 6 in accordance with aspects herein.
Figure 8:
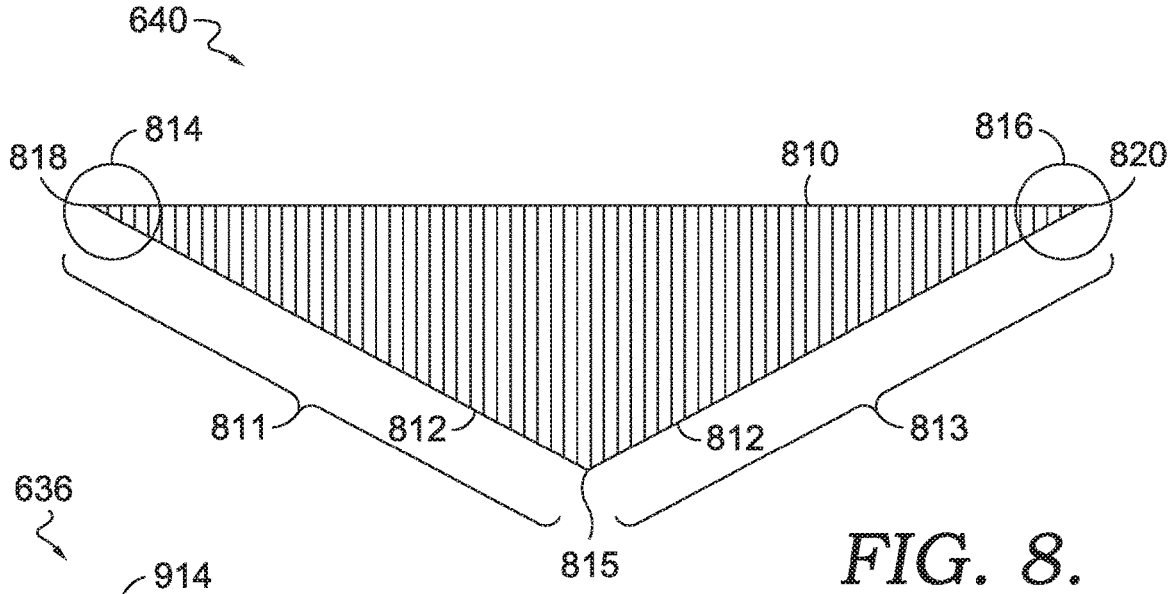
FIG. 8 illustrates a view of a back collar panel of the second collar configuration in accordance with aspects herein.
Figure 9:
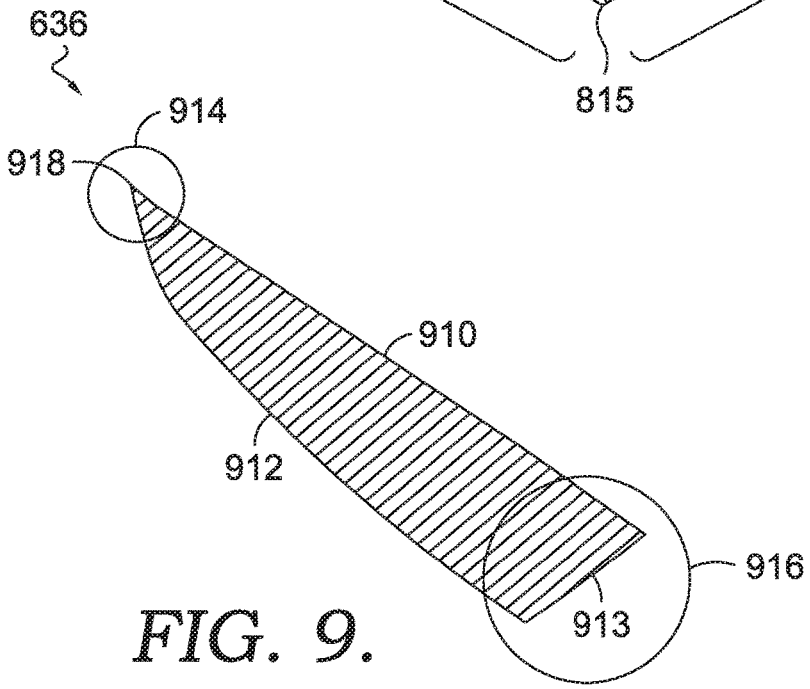
FIG. 9 illustrates a view of a first front collar panel of the second collar configuration in accordance with aspects herein.
Figure 10:
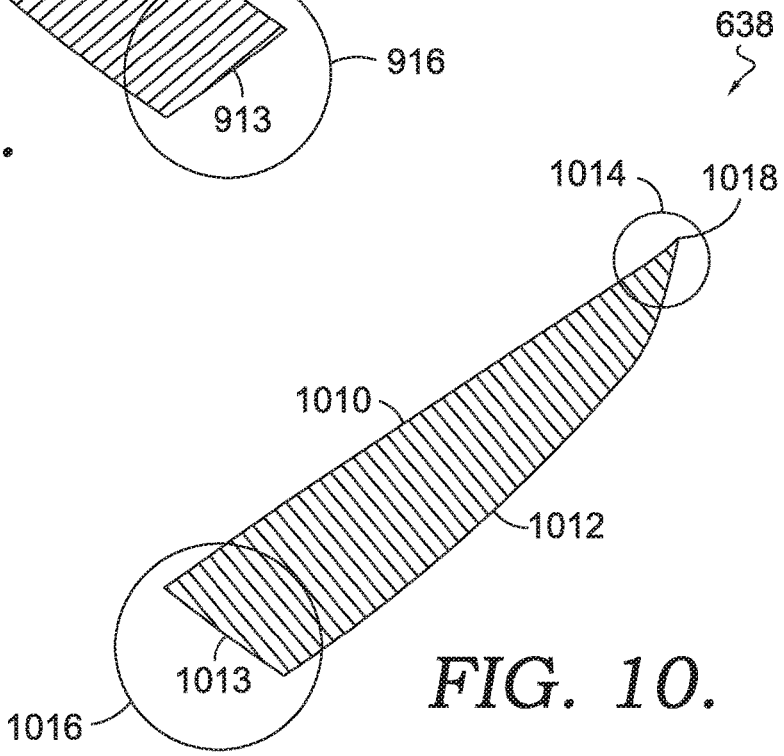
FIG. 10 illustrates a view of a second front collar panel of the second collar configuration in accordance with aspects herein.

FIG. 7A illustrates a front, close-up view of the collar construction 634, while FIG. 8 depicts a pattern piece used to form the back collar panel 640, and FIGS. 9 and 10 depict pattern pieces used to form the first front collar panel 636 and the second front collar panel 638 respectively in accordance with aspects herein. Referring collectively to FIGS. 7A and 8, the back collar panel 640, which has a similar construction to the back collar panel 138, comprises a superior edge 810, an inferior edge 812, a first terminal end 814, and a second terminal end 816 opposite the first terminal end 814. Before being incorporated into the collar construction 634, the superior edge 810 of the back collar panel 640 may linearly extend (i.e., extend in a horizontal direction) between the first terminal end 814 and the second terminal end 816 as shown in FIG. 8. As further shown in FIG. 8, the inferior edge 812 may comprise a first segment 811 that extends inferiorly from the first terminal end 814 to a vertex 815 and a second segment 813 that extends inferiorly from the second terminal end 816 to the vertex 815 resulting in a V-shaped inferior edge.

With continued respect to FIG. 8, in example aspects, the first terminal end 814 and the second terminal end 816 of the back collar panel 640 may comprise respective areas adjacent to where the superior edge 810 of the back collar panel 640 intersects the inferior edge 812 of the back collar panel 640. More particularly, the first terminal end 814 of the back collar panel 640 may comprise an area adjacent to where the superior edge 810 of the back collar panel 640 intersects the first segment 811 of the inferior edge 812 where the intersection point is indicated by reference numeral 818, and the second terminal end 816 of the back collar panel 640 may comprise an area adjacent to where the superior edge 810 of the back collar panel 640 intersects the second segment 813 of the inferior edge 812 where the intersection point is indicated by reference numeral 820. The first terminal end 814 of the back collar panel 640 may comprise an area extending medially from about 1 cm to about 5 cm from the intersection point 818. Likewise, the second terminal end 816 of the back collar panel 640 may comprise an area extending medially from about 1 cm to about 5 cm from the intersection point 820.

When the back collar panel 640 is incorporated into the upper-body garment 600, the inferior edge 812 of the back collar panel 640 is affixed to a back side of the neck opening 614 using, for instance, stitching, adhesives, bonding, seam tape, spot welding, and the like. In example aspects, after the inferior edge 812 of the back collar panel 640 is affixed to the back side of the neck opening 614, the intersection point 818 is positioned adjacent to the first shoulder seam 630 so that the first shoulder seam 630 is in contact or near contact with the intersection point 818, and the intersection point 820 is positioned adjacent to the second shoulder seam 632 so that the second shoulder seam 632 is in contact or near contact with the intersection point 820.

Referring now collectively to FIGS. 7A and 9, the first front collar panel 636 comprises a superior edge 910, an inferior edge 912, a first terminal end 914, and a second terminal end 916 opposite the first terminal end 914. In example aspects, the superior edge 910 may linearly extend between the first terminal end 914 and the second terminal end 916, while the inferior edge 912 may have an arcuate shape extending between the first terminal end 914 and the second terminal end 916.

With further respect to FIG. 9, in example aspects, the first terminal end 914 of the first front collar panel 636 may comprise an area adjacent to where the superior edge 910 of the first front collar panel 636 intersects the inferior edge 912 of the first front collar panel 636 at a first lateral side of the first front collar panel 636 as indicated by an intersection point 918. For example, the first terminal end 914 of the first front collar panel 636 may comprise an area extending medially from about 1 cm to about 5 cm from the intersection point 918. The second terminal end 916 of the first front collar panel 636 may comprise a different construction in example aspects. For instance, the second terminal end 916 may comprise an area adjacent to where a panel edge 913 extends between the superior edge 910 and the inferior edge 912. For instance, the second terminal end 916 of the first front collar panel 636 may comprise an area extending laterally from about 1 cm to about 5 cm from the panel edge 913.

When the first front collar panel 636 is incorporated into the upper-body garment 600, the inferior edge 912 of the first front collar panel 636 is affixed to a first front side of the neck opening 614 using, for instance, stitching, adhesives, bonding, seam tape, spot welding, and the like. The intersection point 918 of the first front collar panel 636 is positioned posterior to the intersection point 818 of the back collar panel 640 so that the first terminal end 914 of the first front collar panel 636 is in an overlapping relationship with the first terminal end 814 of the back collar panel 640.

Referring now collectively to FIGS. 7A and 10, the second front collar panel 638 comprises a superior edge 1010, an inferior edge 1012, a first terminal end 1014, and a second terminal end 1016 opposite the first terminal end 1014. In example aspects, the superior edge 1010 may linearly extend between the first terminal end 1014 and the second terminal end 1016, while the inferior edge 1012 may have an arcuate shape extending between the first terminal end 1014 and the second terminal end 1016.

With further respect to FIG. 10, in example aspects, the first terminal end 1014 of the second front collar panel 638 may comprise an area adjacent to where the superior edge 1010 of the second front collar panel 638 intersects the inferior edge 1012 of the second front collar panel 638 at a first lateral side of the second front collar panel 638 as indicated by an intersection point 1018. For example, the first terminal end 1014 of the second front collar panel 638 may comprise an area extending medially from about 1 cm to about 5 cm from the intersection point 1018. The second terminal end 1016 of the second front collar panel 638 may comprise a different construction in example aspects. For instance, the second terminal end 1016 may comprise an area adjacent to where a panel edge 1013 extends between the superior edge 1010 and the inferior edge 1012. For instance, the second terminal end 1016 of the second front collar panel 638 may comprise an area extending laterally from about 1 cm to about 5 cm from the panel edge 1013.

When the second front collar panel 638 is incorporated into the upper-body garment 600, the inferior edge 1012 of the second front collar panel 638 is affixed to a second front side of the neck opening 614 using, for instance, stitching, adhesives, bonding, seam tape, spot welding, and the like. The intersection point 1018 of the second front collar panel 638 is positioned posterior to the intersection point 820 of the back collar panel 640 so that the first terminal end 1014 of the second front collar panel 638 is in an overlapping relationship with the second terminal end 816 of the back collar panel 640.

With respect to the first front collar panel 636, the second front collar panel 638 and the back collar panel 640, and as shown in FIGS. 8-10, the panels 636, 638 and 640 may be formed of a two-way or four-way stretch material such as, for example, a ribbed knit material that has a stretch characteristic Like the upper-body garment 100, the first front collar panel 636, the second front collar panel 638 and the back collar panel 640 may be seamed or joined to the neck opening 614 of the upper-body garment 600 so that the long axes of the ribs of the ribbed knit material forming the first front collar panel 636, the second front collar panel 638 and the back collar panel 640, are oriented generally perpendicular to the superior edges 910, 1010, and 810 of the first front collar panel 636, the second front collar panel 638 and the back collar panel 640 respectively to provide enhanced stretch in the lateral direction.

Figure 7B:
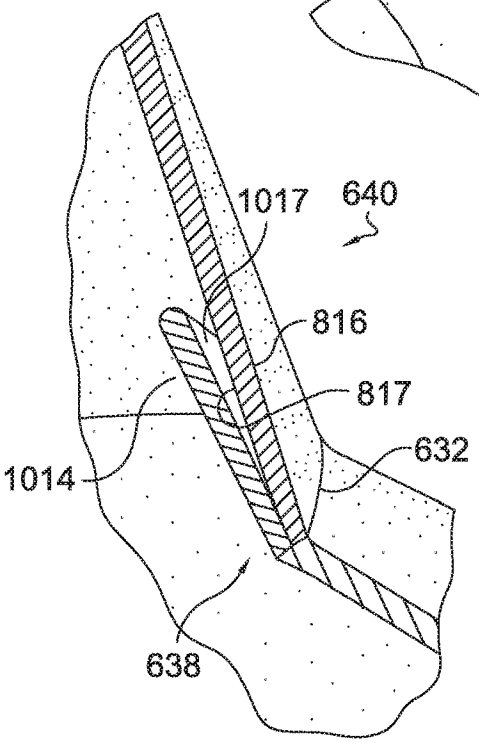
FIG. 7B illustrates a cross-sectional view taken along cut line 7B-7B of FIG. 7A in accordance with aspects herein.

Referring now to FIG. 7B, in example aspects, the first terminal end 1014 of the second front collar panel 638 is positioned medial to (i.e., closer to a median plane of the upper-body garment 600) the second terminal end 816 of the back collar panel 640 so that the first terminal end 1014 of the second front collar panel 638 and the second terminal end 816 of the back collar panel 640 are in an overlapping relationship at a second side 714 of the neck opening 614. Similarly, the first terminal end 914 of the first front collar panel 636 is positioned medial to the first terminal end 814 of the back collar panel 640 so that the first terminal end 914 of the first front collar panel 636 and the first terminal end 814 of the back collar panel 640 are in an overlapping relationship at a first side 712 of the neck opening 614.

FIG. 7B further illustrates that although the first terminal end 1014 of the second front collar panel 638 is in an overlapping relationship with the second terminal end 816 of the back collar panel 640, and although the first terminal end 914 of the first front collar panel 636 is in an overlapping relationship with the first terminal end 814 of the back collar panel 640, the respective terminal ends 914 and 814, and 1014 and 816 are detached from each other in areas except for where the terminal ends 914 and 814, and 1014 and 816 are seamed or attached to the neck opening 614 of the upper-body garment 600. To describe this differently, an inner-facing surface 817 of the first and second terminal ends 814 and 816 of the back collar panel 640 are detached from or not affixed to an outer-facing surface 1017 of the first terminal end 914 of the first front collar panel 636 and the first terminal end 1014 of the second front collar panel 638. As stated previously, this construction enables the back collar panel 640, the first front collar panel 636, and the second front collar panel 638 to move independently of each other at the first side 712 and the second side 714 of the neck opening 614 to allow for greater stretch when donning and doffing the upper-body garment 600.

Similar to above, it is also contemplated herein that the first terminal end 914 of the first front collar panel 636 may be positioned lateral to (i.e., further away from the median plane of the upper-body garment 600) the first terminal end 814 of the back collar panel 640 at the first side 712 of the neck opening 614, and the first terminal end 1014 of the second front collar panel 638 may be positioned lateral to the second terminal end 816 of the back collar panel 640 at the second side 714 of the neck opening 614. Any and all aspects, and any variation thereof, are contemplated as being within aspects herein.

With respect to the second terminal ends 916 and 1016 of the first front collar panel 636 and the second front collar panel 638 respectively, it is contemplated herein that the second terminal ends 916 and 1016 may be positioned in an overlapping relationship as shown in FIG. 7A. To describe this differently, it is contemplated herein that the second terminal end 916 of the first front collar panel 636 may be positioned interior to the second terminal end 1016 of the second front collar panel 638 although the opposite relationship is also contemplated. It is further contemplated, that the second terminal end 916 of the first front collar panel 636 may be detached from the second terminal end 1016 of the second front collar panel 638, or the second terminal end 916 of the first front collar panel 636 may be attached to the second terminal end 1016 of the second front collar panel 638. Any and all aspects, and any variation thereof, are contemplated as being within aspects herein.

Figure 11:
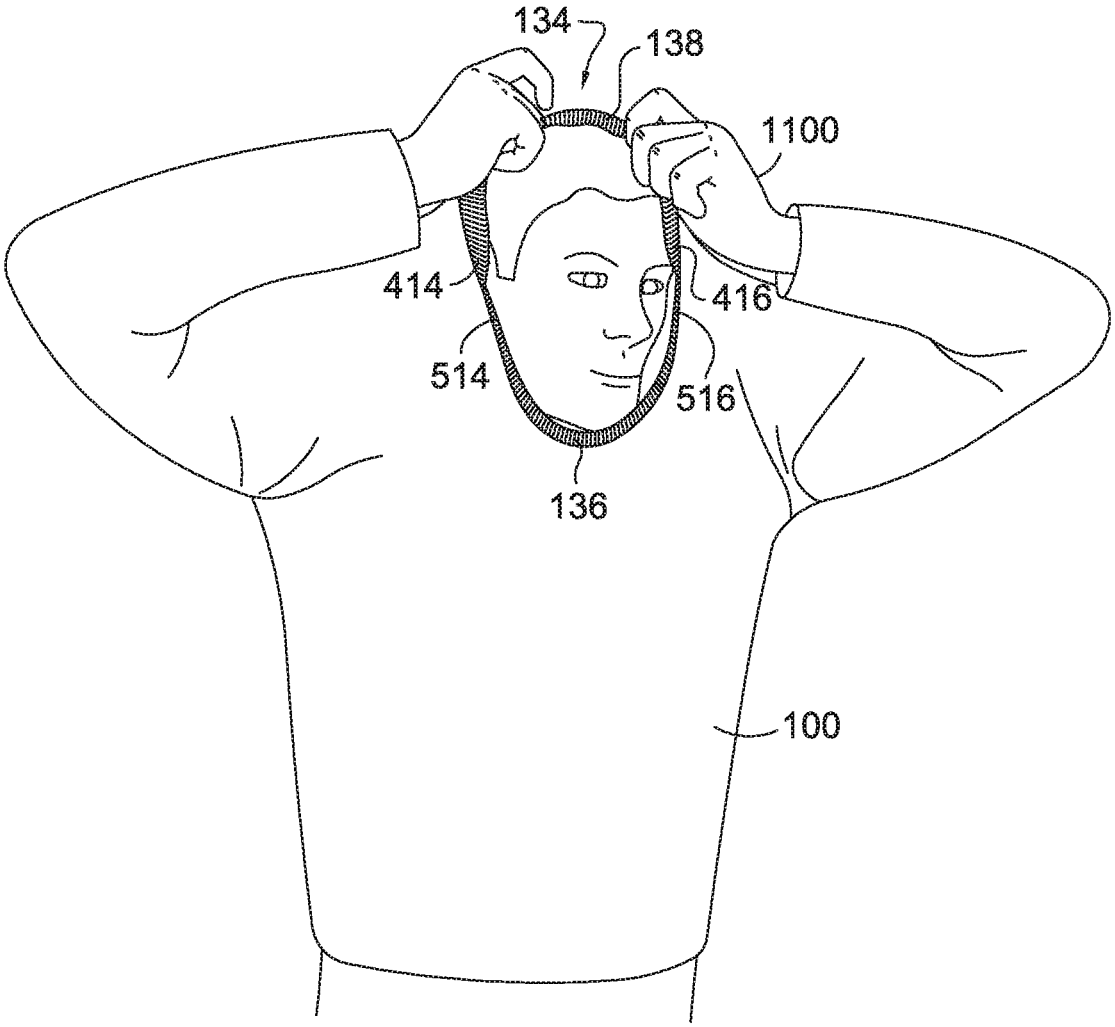
FIG. 11 illustrates a wearer donning the first example upper-body garment of FIG. 1 in accordance with aspects herein.

FIG. 11 depicts an example wearer 1100 donning the upper-body garment 100 in accordance with aspects herein. As shown, when pulling the upper-body garment 100 over the wearer's head, the overlapping relationship between first and second terminal ends 414 and 416 of the back collar panel 138 and the first and second terminal ends 514 and 516 of the front collar panel 136 may allow for a greater degree of stretch in the anterior-to-posterior direction and in the lateral direction. To state it differently, because the first and second terminal end 414 and 416 of the back collar panel 138 are in an overlapping relationship with the first and second terminal ends 514 and 516 of the front collar panel 136 but are detached from the first and second terminal ends 514 and 516 of the front collar panel 136, there is an extra volume of material at the first and second sides of the neck opening 114 that enables a greater degree of stretch. A depiction of an example wearer donning the upper-body garment 600 would share similar features.

Aspects associated with the collar constructions described above may also be applied to other articles of apparel. For instance, the collar construction 134 may be applied to a waistband of a lower-body garment such that the waistband comprises a front waistband piece having terminal ends and a back waistband piece having terminal end where the terminal ends of the front waistband piece and the terminal ends of the back waistband piece are in an overlapping and detached relationship at opposing lateral sides of the lower-body garment. Similar to the collar construction, this may facilitate easier donning and doffing of the lower-body garment.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An upper-body garment comprising:

a front portion and a back portion that together define at least a neck opening;

a front collar panel having a superior edge, an inferior edge, a first terminal end, and a second terminal end, the inferior edge of the front collar panel affixed to a front side of the neck opening; and a back collar panel having a superior edge, an inferior edge, a first terminal end, and a second terminal end, the inferior edge of the back collar panel affixed to a back side of the neck opening, wherein the first terminal end of the front collar panel is in an overlapping relationship with the first terminal end of the back collar panel at a first side of the neck opening, and wherein the second terminal end of the front collar panel is in an overlapping relationship with the second terminal end of the back collar panel at a second side of the neck opening.

Clause 2. The upper-body garment according to clause 1, wherein the first terminal end of the front collar panel is at least partially detached from the first terminal end of the back collar panel, and wherein the second terminal end of the front collar panel is at least partially detached from the second terminal end of the back collar panel.

Clause 3. The upper-body garment according to any of clauses 1 through 2, wherein the first terminal end of the front collar panel is positioned medial to the first terminal end of the back collar panel, and wherein the second terminal end of the front collar panel is positioned medial to the second terminal end of the back collar panel.

Clause 4. The upper-body garment according to any of clauses 1 through 3, wherein the first terminal end of the front collar panel is positioned lateral to the first terminal end of the back collar panel, and wherein the second terminal end of the front collar panel is positioned lateral to the second terminal end of the back collar panel.

Clause 5. The upper-body garment according to any of clauses 1 through 4, wherein the front portion and the back portion of the upper-body garment are formed from a first material having a first stretch characteristic, and wherein the front collar panel and the back collar panel are formed from a second material having a second stretch characteristic.

Clause 6. The upper-body garment according to clause 5, wherein the second stretch characteristic is greater than the first stretch characteristic.

Clause 7. The upper-body garment according to any of clauses 5 through 6, wherein the second material comprises a knit material having a plurality of ribbed knit structures.

Clause 8. The upper-body garment according clause 7, wherein a longitudinal axis of each rib of the plurality of ribbed knit structures is oriented generally perpendicular to the superior edge of the respective front collar panel and back collar panel.

Clause 9. The upper-body garment according to any of clauses 1 through 8, wherein the inferior edge of the back collar panel comprises a first segment that extends inferiorly from the first terminal end of the back collar panel to a vertex and a second segment that extends inferiorly from the second terminal end of the back collar panel to the vertex to form a V-shape.

Clause 10. An upper-body garment comprising:

a front portion and a back portion that together define at least a neck opening;

a first front collar panel having a superior edge, an inferior edge, a first terminal end, and a second terminal end, the inferior edge of the first front collar panel affixed to a first front side of the neck opening;

a second front collar panel having a superior edge, an inferior edge, a first terminal end, and a second terminal end, the inferior edge of the second front collar panel affixed to a second front side of the neck opening; and a back collar panel having a superior edge, an inferior edge, a first terminal end, and a second terminal end, the inferior edge of the back collar panel affixed to a back side of the neck opening, wherein the first terminal end of the first front collar panel is in an overlapping relationship with the first terminal end of the back collar panel at a first side of the neck opening, and wherein the first terminal end of the second front collar panel is in an overlapping relationship with the second terminal end of the back collar panel at a second side of the neck opening.

Clause 11. The upper-body garment according to clause 10, wherein the second terminal end of the first front collar panel is in an overlapping relationship with the second terminal end of the second front collar panel at a center front of the neck opening.

Clause 12. The upper-body garment according to any of clauses 10 through 11, wherein the first terminal end of the first front collar panel is at least partially detached from the first terminal end of the back collar panel, and wherein the first terminal end of the second front collar panel is at least partially detached from the second terminal end of the back collar panel.

Clause 13. The upper-body garment according to any of clauses 10 through 12, wherein the first terminal end of the first front collar panel is positioned medial to the first terminal end of the back collar panel, and wherein the first terminal end of the second front collar panel is positioned medial to the second terminal end of the back collar panel.

Clause 14. The upper-body garment according to any of clauses 10 through 12, wherein the first terminal end of the first front collar panel is positioned lateral to the first terminal end of the back collar panel, and wherein the first terminal end of the second front collar panel is positioned lateral to the second terminal end of the back collar panel.

Clause 15. The upper-body garment according to any of clauses 10 through 14, wherein the front portion and the back portion of the upper-body garment are formed of a first material having a first stretch characteristic, wherein the first front collar panel, the second front collar panel, and the back collar panel are formed from a second material having a second stretch characteristic, and wherein the second stretch characteristic is greater than the first stretch characteristic.

Clause 16. An upper-body garment comprising:

a front portion and a back portion that together define at least a neck opening, the front portion and the back portion formed from a first material having a first stretch characteristic;

a front collar panel having a superior edge, an inferior edge, a first terminal end, and a second terminal end, the inferior edge of the front collar panel affixed to a front side of the neck opening; and a back collar panel having a superior edge, an inferior edge, a first terminal end, and a second terminal end, the inferior edge of the back collar panel affixed to a back side of the neck opening, wherein: the front collar panel and the back collar panel are formed from a second material having a second stretch characteristic that is greater than the first stretch characteristic, the first terminal end of the front collar panel is in an overlapping relationship with the first terminal end of the back collar panel at a first side of the neck opening, and the second terminal end of the front collar panel is in an overlapping relationship with the second terminal end of the back collar panel at a second side of the neck opening.

Clause 17. The upper-body garment according to clause 16, wherein the second material comprises a knit material having a plurality of ribbed knit structures.

Clause 18. The upper-body garment according to clause 17, wherein a longitudinal axis of each rib of the plurality of ribbed knit structures is oriented generally perpendicular to the superior edge of the respective front collar panel and back collar panel.

Clause 19. The upper-body garment according to any of clauses 16 through 18, wherein: the front portion and the back portion of the upper-body garment are joined together at least at a first shoulder seam and a second shoulder seam, the first terminal end of the front collar panel and the first terminal end of the back collar panel are positioned adjacent to the first shoulder seam, and the second terminal end of the front collar panel and the second terminal end of the back collar panel are positioned adjacent to the second shoulder seam.

Clause 20. The upper-body garment according to any of clauses 16 through 19, wherein the inferior edge of the back collar panel comprises a first segment that extends inferiorly from the first terminal end of the back collar panel to a vertex and a second segment that extends inferiorly from the second terminal end of the back collar panel to the vertex to form a V-shape.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An upper-body garment comprising:

a front portion and a back portion that together define at least a neck opening;

one or more front collar panels having a superior edge, an inferior edge, a first terminal end, and a second terminal end, the inferior edge of the one or more front collar panels affixed to a front side of the neck opening; and a back collar panel having a superior edge, an inferior edge, a first terminal end, and a second terminal end, the inferior edge of the back collar panel affixed to a back side of the neck opening, wherein the first terminal end of the one or more front collar panels is in an overlapping relationship with the first terminal end of the back collar panel at a first side of the neck opening to form a first intersection point such that the back collar panel is positioned as an outer-most layer at the first intersection point and the one or more front collar panels are positioned as an inner-most layer at the first intersection point, and wherein the second terminal end of the one or more front collar panels is in an overlapping relationship with the second terminal end of the back collar panel at a second side of the neck opening to form a second intersection point such that the back collar panel is positioned as the outer-most layer at the second intersection point and the one or more front collar panels is positioned as the inner-most layer at the second intersection point, and wherein the inferior edge of the back collar panel comprises a first segment that extends inferiorly from the first intersection point to a vertex and a second segment that extends inferiorly from the second intersection point to the vertex to form a V- shape; and wherein the overlapping relationship of the first terminal end of the one or more front collar panels and the first terminal end of the back collar panel comprises a triangular-shaped overlap, and further wherein the overlapping relationship of the second terminal end of the one or more front collar panels and the second terminal end of the back collar panel also comprises a triangular-shaped overlap.

2. The upper-body garment of claim 1, wherein at the first intersection point and at the second intersection point the superior edge of the back collar panel overlaps with, and is at least partially detached from, the superior edge of the one or more front collar panels.

3. The upper-body garment of claim 1, wherein the first terminal end of the one or more front collar panels is positioned medial to the first terminal end of the back collar panel, and wherein the second terminal end of the one or more front collar panels is positioned medial to the second terminal end of the back collar panel.

4. The upper-body garment of claim 1, wherein the front portion and the back portion of the upper-body garment are formed from a first material having a first stretch characteristic, and wherein the one or more front collar panels and the back collar panel are formed from a second material having a second stretch characteristic.

5. The upper-body garment of claim 4, wherein the second stretch characteristic is greater than the first stretch characteristic.

6. The upper-body garment of claim 4, wherein the second material comprises a knit material having a plurality of ribbed knit structures.

7. The upper-body garment of claim 6, wherein a longitudinal axis of each rib of the plurality of ribbed knit structures is oriented generally perpendicular to the superior edge of the respective one or more front collar panels and the back collar panel.

8. An upper-body garment comprising:

a front portion and a back portion that together define at least a neck opening;

a first front collar panel having a superior edge, an inferior edge, a first terminal end, and a second terminal end, the inferior edge of the first front collar panel affixed to a first front side of the neck opening;

a second front collar panel having a superior edge, an inferior edge, a first terminal end, and a second terminal end, the inferior edge of the second front collar panel affixed to a second front side of the neck opening; and a back collar panel having a superior edge, an inferior edge, a first terminal end, and a second terminal end, the inferior edge of the back collar panel affixed to a back side of the neck opening, wherein the first terminal end of the first front collar panel is in an overlapping relationship with the first terminal end of the back collar panel at a first side of the neck opening to form a first intersection point such that the back collar panel is positioned as an outer-most layer at the first intersection point and the first front collar panel is positioned as an inner-most layer at the first intersection point, and wherein the first terminal end of the second front collar panel is in an overlapping relationship with the second terminal end of the back collar panel at a second side of the neck opening to form a second intersection point such that the back collar panel is positioned as the outer-most layer at the second intersection point and the second front collar panel is positioned as the inner-most layer at the second intersection point, and wherein the inferior edge of the back collar panel comprises a first segment that extends inferiorly from the first intersection point to a vertex and a second segment that extends inferiorly from the second intersection point to the vertex to form a V-shape and wherein the superior edge of the back collar panel intersects directly with the first segment at the first terminal end of the back collar panel and intersects directly with the second segment at the second terminal end of the back collar to form a triangular back collar panel.

9. The upper-body garment of claim 8, wherein the second terminal end of the first front collar panel is in an overlapping relationship with the second terminal end of the second front collar panel at a center front of the neck opening.

10. The upper-body garment of claim 8, wherein the first terminal end of the first front collar panel is at least partially detached from the first terminal end of the back collar panel, and wherein the first terminal end of the second front collar panel is at least partially detached from the second terminal end of the back collar panel.

11. The upper-body garment of claim 8, wherein the first terminal end of the first front collar panel is positioned medial to the first terminal end of the back collar panel, and wherein the first terminal end of the second front collar panel is positioned medial to the second terminal end of the back collar panel.

12. The upper-body garment of claim 8, wherein the first terminal end of the first front collar panel is positioned lateral to the first terminal end of the back collar panel, and wherein the first terminal end of the second front collar panel is positioned lateral to the second terminal end of the back collar panel.

13. The upper-body garment of claim 8, wherein the first terminal end of the back collar panel and the second terminal end of the back collar panel are spaced apart by a distance.

14. An upper-body garment comprising:

a front portion and a back portion that together define at least a neck opening, the front portion and the back portion formed from a first material having a first stretch characteristic;

one or more front collar panels having a superior edge, an inferior edge, a first terminal end, and a second terminal end, the inferior edge of the one or more front collar panels affixed to a front side of the neck opening;

a back collar panel having a superior edge, an inferior edge, a first terminal end, and a second terminal end, the inferior edge of the back collar panel affixed to a back side of the neck opening;

wherein the one or more front collar panels and the back collar panel are formed from a second material having a second stretch characteristic that is greater than the first stretch characteristic, the first terminal end of the one or more front collar panels is in an overlapping relationship with the first terminal end of the back collar panel at a first side of the neck opening to form a first intersection point, and the second terminal end of the one or more front collar panels is in an overlapping relationship with the second terminal end of the back collar panel at a second side of the neck opening to form a second intersection point, and wherein the inferior edge of the back collar panel comprises a first segment that extends inferiorly from the first intersection point to a vertex and a second segment that extends inferiorly from the second intersection point to the vertex to form a V-shape and wherein the superior edge of the back collar panel intersects directly with the first segment at the first terminal end of the back collar panel and intersects directly with the second segment at the second terminal end of the back collar to form a triangular back collar panel; and wherein the back collar panel is positioned as an outer-most layer at the first intersection point and the one or more front collar panels is positioned as an inner- most layer at the first intersection point, and further wherein the back collar panel is positioned as the outer-most layer at the second intersection point and the one or more front collar panels is positioned as the inner-most layer at the second intersection point.

15. The upper-body garment of claim 14, wherein the second material comprises a knit material having a plurality of ribbed knit structures.

16. The upper-body garment of claim 15, wherein a longitudinal axis of each rib of the plurality of ribbed knit structures is oriented generally perpendicular to the superior edge of the respective one or more front collar panels and the back collar panel.

17. The upper-body garment of claim 14, wherein the front portion and the back portion of the upper-body garment are joined together at least at a first shoulder seam and a second shoulder seam, the first terminal end of the one or more front collar panels and the first terminal end of the back collar panel are positioned adjacent to the first shoulder seam, and the second terminal end of the one or more front collar panels and the second terminal end of the back collar panel are positioned adjacent to the second shoulder seam.

18. The upper-body garment of claim 1, wherein the first terminal end of the back collar panel and the second terminal end of the back collar panel are spaced apart by a distance.

19. The upper-body garment of claim 14, wherein the first terminal end of the back collar panel and the second terminal end of the back collar panel are spaced apart by a distance.

* * * * *